US005361783A

United States Patent [19]

Herburg

[11] Patent Number: 5,361,783

[45] Date of Patent: Nov. 8, 1994

[54] APPARATUS FOR FEEDING WEBS OF WRAPPING MATERIAL

[75] Inventor: Andreas Herburg, Wentorf, Germany

[73] Assignee: Korber AG, Hamburg, Germany

[21] Appl. No.: 138,484

[22] Filed: Oct. 15, 1993

[30] Foreign Application Priority Data

Oct. 30, 1992 [DE] Germany ..... 4-236646

[51] Int. Cl.[5] ..... A24C 5/18

[52] U.S. Cl. ..... 131/84.1; 131/60

[58] Field of Search ..... 131/84.1, 84.2, 108, 131/60

[56] References Cited

U.S. PATENT DOCUMENTS

| | | | |
|---|---|---|---|
| 4,185,644 | 1/1980 | Heitmann et al. | 131/109 R |
| 4,444,209 | 4/1984 | Seragnoli | 131/84.1 X |
| 4,716,909 | 1/1988 | Belvederi et al. | 131/84.1 X |
| 4,721,119 | 1/1988 | Ludszeweit et al. | 131/84.1 X |
| 4,913,329 | 4/1990 | Cahill et al. | 131/84.1 X |
| 4,945,926 | 8/1990 | Mattei et al. | 131/84.1 X |
| 5,060,665 | 10/1991 | Heitmann | 131/84.1 |
| 5,072,741 | 12/1991 | Heitmann | 131/84.1 |
| 5,125,419 | 6/1992 | Heitmann | 131/84.4 |
| 5,154,190 | 10/1992 | Heitmann | 131/84.1 |

FOREIGN PATENT DOCUMENTS

| | | | |
|---|---|---|---|
| 1242182 | 8/1960 | France | 131/108 |

*Primary Examiner*—Jennifer Bahr
*Attorney, Agent, or Firm*—Darby & Darby

[57] ABSTRACT

A cigarette maker or a filter rod making machine wherein a continuous rod-like filler is advanced by an endless foraminous belt conveyor toward a wrapping or draping unit and a web of wrapping material is advanced toward the unit to be draped around the filler. In order to ensure that the leader of a fresh web properly enters the wrapping station, the path for the web is monitored and the belt conveyor for the filler is moved toward the path of the web when a monitoring device detects the leader. If the cigarette maker or the filter rod making machine is designed to simultaneously produce and drape two or more discrete fillers, the paths of the webs are monitored independently of each other and portions of the respective belts are moved toward the oncoming leaders of the webs whenever the respective monitoring devices signal the arrival of leaders in preselected portions of the paths.

18 Claims, 2 Drawing Sheets

APPARATUS FOR FEEDING WEBS OF WRAPPING MATERIAL

BACKGROUND OF THE INVENTION

The invention relates to rod making machines of the tobacco processing industry in general, and more particularly to improvements in machines wherein one or more continuous rod-like fillers of tobacco or filter material for tobacco smoke are draped into discrete running webs of cigarette paper, tipping paper, imitation cork or any other suitable flexible strip-shaped wrapping material. Typical examples of machines to which the present invention pertains are cigarette rod making machines (e.g., of the type known as PROTOS produced and distributed by the assignee of the present application) and filter rod making machines which turn out filter rod sections of unit length or multiple unit length for admission into so-called tipping machines (e.g., machines known as MAX and also produced and distributed by the assignee of the present application) wherein the filter rod sections are united with plain cigarettes by employing adhesive-coated sections of tipping paper to form filter cigarettes of unit length or multiple unit length.

A cigarette rod making machine normally comprises at least one distributor which supplies tobacco particles for the forming of at least one continuous rod-like filler advancing with an endless belt conveyor toward a wrapping unit wherein successive increments of the filler are draped into successive increments of a running web of cigarette paper or other suitable flexible strip-shaped wrapping material. Successive increments of the web are draped around successive increments of the filler and the marginal portions of the thus draped web are bonded to each other to form a seam extending in parallelism with the axis of the resulting cigarette rod. The latter is thereupon conveyed through a so-called cutoff which severs the leader of the rod at desired intervals to form a file or row of plain cigarettes of unit length or multiple unit length.

A cigarette maker of the above outlined character can turn out a continuous rod-like filler for extended periods of time, e.g., during an entire shift. However, the relatively thin and weak web is likely to break from time to time even though it is or even though it can be drawn from a source in the form of a continuous strip, e.g., by splicing the leader of a fresh web to the trailing end of an expiring web when the supply of expiring web is about to be exhausted. If the continuously advanced web breaks, the leader of the next following portion of the web or the leader of a fresh web must be properly advanced to the wrapping station in order to ensure that successive increments of the fresh web will be properly draped around successive increments of the rod-like filler. Otherwise stated, the leader of a fresh web must be properly threaded into the wrapping unit in order to avoid the making of a long series of unacceptable rod-shaped smokers' products whenever the leader of a fresh web is being advanced toward the path for the rod-like filler.

The wrapping unit in a cigarette maker or in a filter rod making machine normally comprises an endless belt which is known as garniture and forms part of the means for draping successive increments of the web around successive increments of the filler while the filler and the web advance at the same speed and in the same direction through the wrapping station of the rod maker. Problems arise if the leader of a fresh web cannot find its way into the wrapping unit, i.e., into engagement with the garniture to be properly entrained during draping around the adjacent increments of the filler.

OBJECTS OF THE INVENTION

An object of the invention is to provide a novel and improved apparatus which is constructed and assembled in such a way that it reliably prevents the leader of a fresh running web from missing the wrapping unit in a rod making machine of the tobacco processing industry.

Another object of the invention is to provide an apparatus which can be installed and used in existing machines for the making of continuous rods containing fillers of natural, reconstituted and/or artificial tobacco or for the making of continuous rods having fillers containing filter material for tobacco smoke.

A further object of the invention is to provide an apparatus which can automatically detect the leader of a fresh running web or the leader of the second part of a broken running web and can automatically ensure that such leader reaches the wrapping unit in a maker of cigarettes, filter rod sections or other rod-shaped articles of the tobacco processing industry.

An additional object of the invention is to provide a rod making machine which embodies an apparatus of the above outlined character.

Still another object of the invention is to provide an apparatus which can be put to use in machines of the type designed to turn out a single rod-like filler or in machines which are designed to simultaneously turn out a plurality of rod-like fillers each of which must be draped into a discrete web of wrapping material.

A further object of the invention is to provide an apparatus which reduces the number of rejects in a rod making machine of the tobacco processing industry and/or in a production line which employs one or more rod making machines.

Another object of the invention is to provide a novel and improved method of manipulating the leaders of running webs in the region of the wrapping station in a rod making machine of the above outlined character.

An additional object of the invention is to provide a method which can be practiced in existing rod making machines of the tobacco processing industry.

Still another object of the invention is to provide an apparatus of the above outlined character with novel and improved means for influencing the positions of a running web of wrapping material and of a running filler of tobacco or filter material for tobacco smoke relative to each other.

A further object of the invention is to provide the above outlined apparatus with a prime mover which can be used in or with a machine for the making of a single filler of tobacco or filter material or for simultaneous making of several fillers.

SUMMARY OF THE INVENTION

The invention is embodied in an apparatus for uniting a running web or strip of flexible wrapping material with a substantially rod-like filler of particulate material (such as tobacco or filter material for tobacco smoke) of the tobacco processing industry. The improved apparatus comprises first conveyor means having means for advancing the filler lengthwise along a first path in a first direction toward a wrapping or uniting station, second conveyor means having means for advancing the web in a second direction toward the station along a second path including a portion disposed at a first distance from a portion of the first path, and means for at least temporarily reducing the first distance to a lesser second distance including means for moving at least one of the advancing means toward the other advancing means. The aforementioned portions of the first and second paths are or can be located close to or even in immediate proximity of the station.

The improved apparatus further comprises means for draping the web around the filler at the wrapping station, and such draping means can include third conveyor means having means for jointly advancing the web and the filler along a third path. The third path can constitute an extension of one of the first and second paths, preferably an extension of the first path.

The running web expires sooner or later and must be replaced with a fresh web having a leader. The distance reducing means preferably includes means for actuating the moving means to reduce the first distance on advancement of the leader of a fresh web into the aforementioned portion of the second path.

The arrangement is or can be such that the moving means of the distance reducing means includes means for moving the advancing means of the first conveyor means toward the advancing means of the second conveyor means.

The distance reducing means can further comprise means for activating the moving means for predetermined intervals of time, particularly when the leader of a fresh web arrives at the aforementioned portion of the second path. The activating means can include means for monitoring the second path for the arrival of the leader of a fresh web at the aforementioned portion of the second path and for activating the moving means for the predetermined interval of time upon detected arrival of the leader.

At least one of the advancing means can comprise an endless flexible conveyor, e.g., an endless foraminous belt conveyor.

The at least one advancing means is or can be located at a level above the other advancing means, i.e., the first distance can be reduced by moving the at least one advancing means downwardly or substantially downwardly toward the other advancing means.

The apparatus can be designed to unite each of a plurality of running webs with a discrete one of a plurality of substantially rod-like fillers. The first conveyor means of such apparatus can include discrete advancing means for the plurality of fillers, and the second conveyor means of such apparatus can comprise discrete or joint advancing means for the plurality of webs. Each advancing means of the first conveyor means is adjacent the advancing means or one advancing means of the second conveyor means, and the distance reducing means of such apparatus includes means for at least temporarily moving each advancing means of one of the first and second conveyor means toward the adjacent advancing means of the other of the first and second conveyor means.

At least one of the first and second conveyor means can comprise two advancing means.

The paths which are defined by the advancing means of at least one of the first and second conveyor means are or can be at least substantially parallel to each other. Furthermore, the advancing means of at least one of the first and second conveyor means are or can be closely adjacent each other.

The moving means of distance reducing means in an apparatus employing first and second conveyor means at least one of which comprises a plurality of advancing means can include a discrete moving device for each advancing means of the at least one conveyor means. Such distance reducing means can further comprise common drive means for all of the discrete moving devices. For example, each discrete moving device can comprise a reciprocable pusher, and the common drive means can comprise a fluid-operated motor for such pushers.

The novel features which are considered as characteristic of the invention are set forth in particular in the appended claims. The improved apparatus itself, however, both as to its construction and the mode of assembling and operating the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
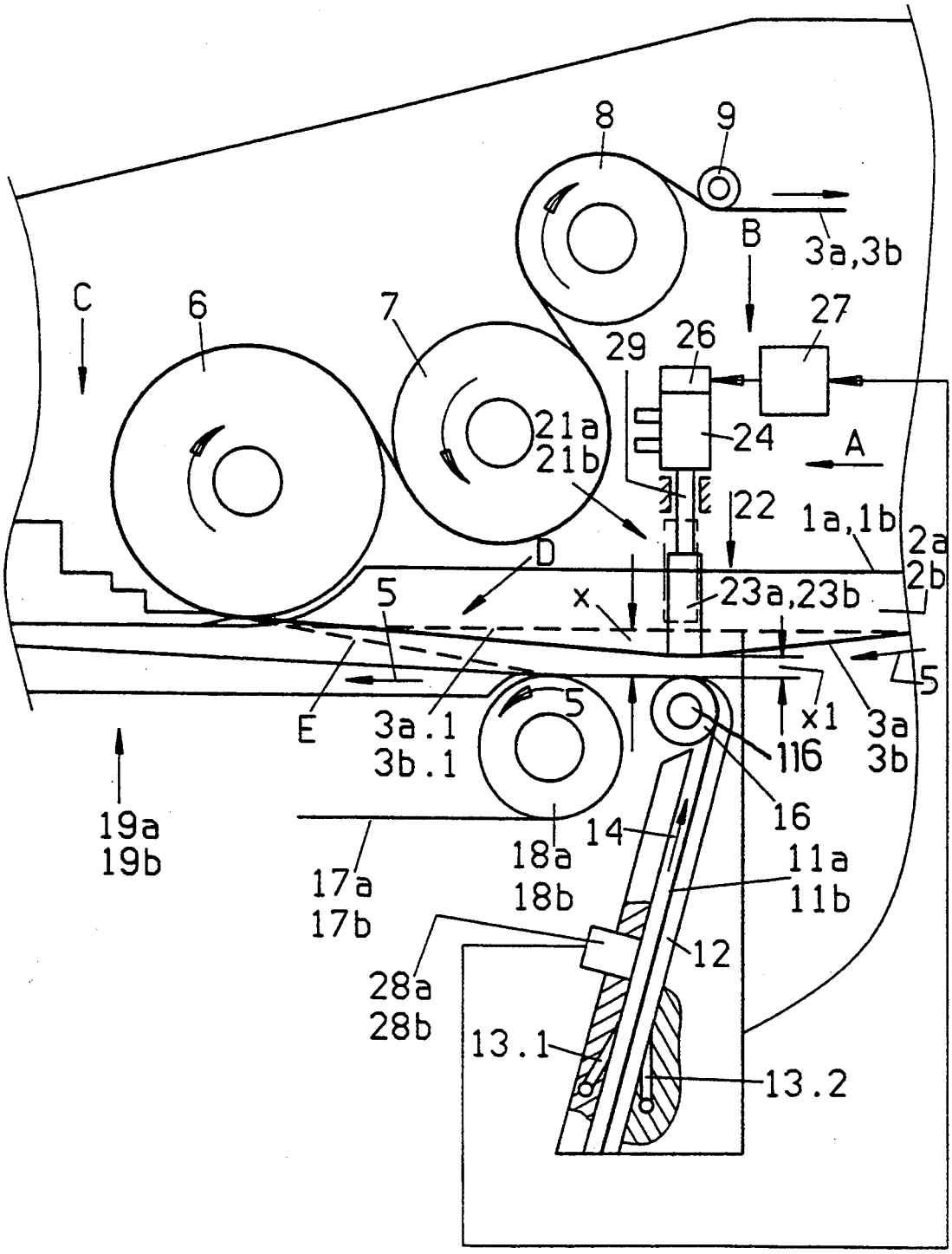
FIG. 1 is a fragmentary elevational view of a twin cigarette making machine which is provided with an apparatus embodying one form of the present invention.
Figure 2:
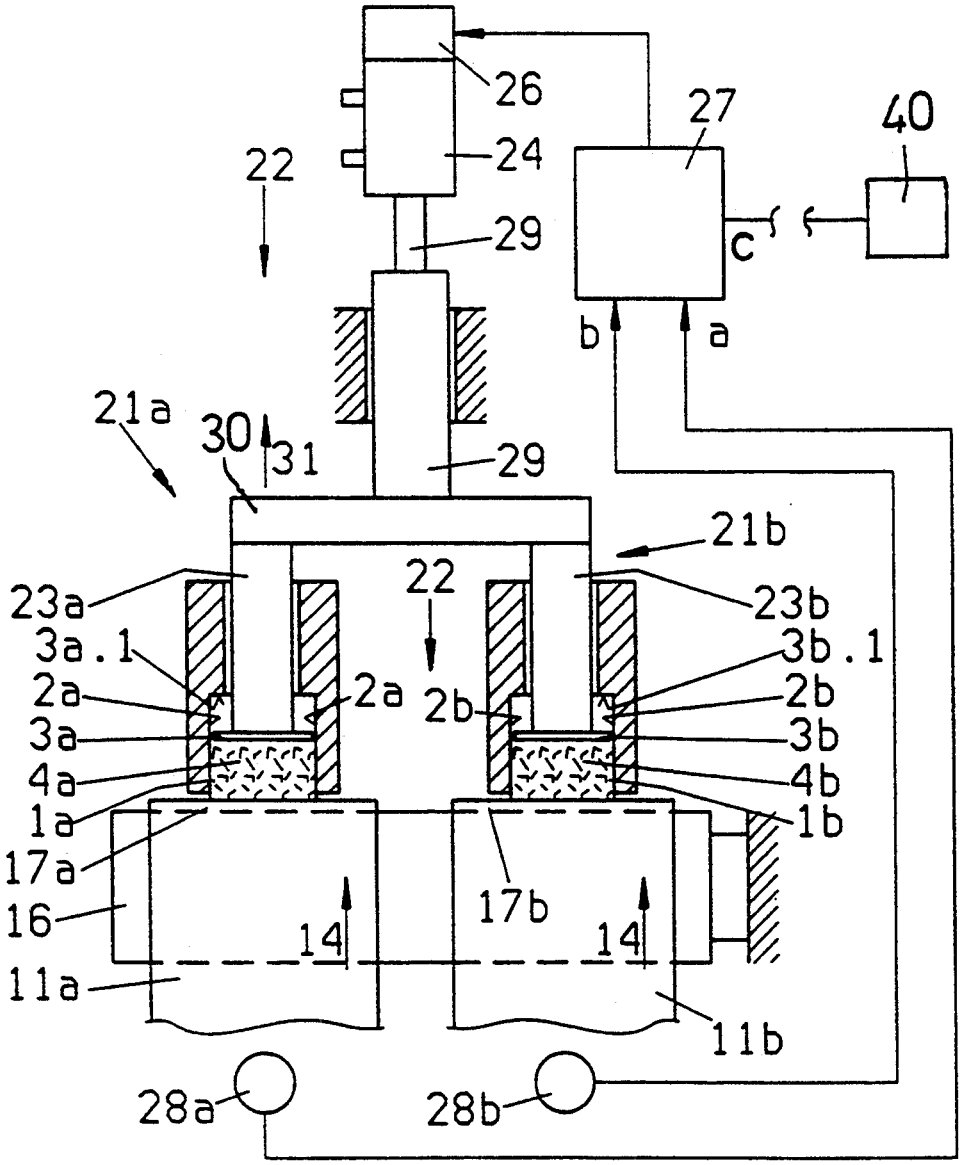
FIG. 2 is a fragmentary schematic partly transverse vertical sectional view substantially as seen in the direction of arrow A in FIG. 1.

FIGS. 1 and 2 illustrate a portion of a twin cigarette rod making machine, e.g., a machine of the type described and shown in commonly owned U.S. Pat. Nos. 5,060,665 (granted Oct. 29, 1991 to Heitmann), 5,072,741 (granted Dec. 17, 1991 to Heitmann) and 5,125,419 (granted Jun. 30, 1992 to Heitmann). The disclosures of the above enumerated patents and all other patents mentioned herein are incorporated by reference. The machine is designed to simultaneously produce two discrete continuous rod-like fillers 4*a*, 4*b* which contain or consist of particles of natural, reconstituted and/or artificial tobacco. Machines of such character are known as PROTOS 2 and are produced and distributed by the assignee of the present application. The fillers 4*a*, 4*b* are shaped in a manner as disclosed, for example, in the aforementioned patents to Heitmann and are transported in the directions indicated by arrows 5 by discrete advancing means in the form of endless foraminous belts 3*a*, 3*b*. These belts form part of a first conveyor further including the pulleys 6, 7, 8 and 9 (shown in FIG. 1) as well as additional pulleys which are not shown in the drawings. One or more pulleys are driven to move the lower reaches of the belts 3*a*, 3*b* in the directions indicated by the arrows 5. The paths along which the fillers 4*a*, 4*b* are advanced toward a wrapping or uniting station C are defined by the lower reaches of the belts 3*a* and 3*b*. Such lower reaches are adjacent the undersides of two discrete suction chambers or to the underside of a common suction chamber which ensures that the fillers are attracted to the belts by suction. All this is well known in the art of making rod-like fillers which are to be draped into webs of cigarette paper or other suitable wrapping material in order to form continuous filter rods which are ready to be subdivided into plain cigarettes of unit length or multiple unit length.

The first conveyor further includes two discrete inverted channels 1*a*, 1*b* for the lower reaches of the respective belts 3*a*, 3*b*, and the channels 1*a*, 2*b* respectively include pairs of sidewalls 2*a*, 2*b* which flank the respective fillers 4*a*, 4*b* on their way toward the corresponding wrapping units 19*a*, 19*b*. When the rod making machine operates normally, the upper sides of the lower reaches of the belts 3*a*, 3*b* respectively abut the bottom surfaces 3*a*.1 and 3*b*.1 in the corresponding channels 1*a*, 1*b*.

The apparatus which embodies the present invention and forms part of the twin rod making machine shown in FIGS. 1 and 2 further comprises a second conveyor having means (here shown as an elongated driven pulley 16) for advancing to the wrapping station C two discrete webs 11*a*, 11*b* of cigarette paper or other suitable strip-shaped wrapping material for the respective fillers 4*a* and 4*b*. The second conveyor further comprises means (such as a shaft 116) for driving the pulley 16 at a peripheral speed corresponding to the speed of the fillers 4*a* and 4*b*. Still further, the second conveyor includes a single upwardly sloping channel or duct 12 or discrete upwardly sloping channels or ducts wherein the webs 11*a*, 11*b* advance from discrete sources (not shown), e.g., in the form of reels of convoluted cigarette paper webs. The directions in which the webs 11*a*, 11*b* are advanced toward, around and thereupon past the pulley 16 are indicated by arrows 14.

The second conveyor (for the webs 11*a*, 11*b*) further comprises means for blowing jets of a compressed gaseous fluid (e.g., air) into the duct 12 in directions to advance the respective webs toward the pulley 16. FIG. 1 shows two nozzles 13.1 and 13.2 which are provided in the duct 12 and have single orifices or sets of orifices serving to discharge jets of gaseous fluid substantially in the direction indicated by the arrows 14.

A third conveyor forms part of the wrapping units 19*a*, 19*b* for the fillers 4*a* and 4*b*, respectively. Such third conveyor comprises means for advancing the fillers 4*a*, 4*b* and the corresponding webs 11*a*, 11*b* toward, through and (if necessary) beyond the wrapping station C. The illustrated advancing means of the third conveyor includes two endless flexible belts 17*a*, 17*b* which are known as garnitures and are respectively trained over pulleys 18*a*, 18*b* as well as over additional pulleys which are not shown in the drawings. At least one pulley for each of the garnitures 17*a*, 17*b* is driven to move the upper reaches of the respective garnitures along third paths which preferably constitute or at least approach extensions of the respective first paths (defined by the lower reaches of the foraminous belts 3*a*, 3*b*).

The configuration of the wrapping units 19*a* and 19*b* is such that the upper reaches of the respective garnitures 19*a*, 19*b* are caused to drape the corresponding webs 11*a*, 11*b* around the aligned fillers 4*a*, 4*b* so that the marginal portions of each web overlap each other and are bonded to one another in a customary way to jointly form a seam extending in parallelism with the axis of the resulting cigarette rod. The garnitures 17*a*, 17*b* are caused to convert the fillers 4*a*, 4*b* into elongated bodies having a substantially circular cross-sectional outline.

The upper reaches of the driven garnitures 17*a*, 17*b* begin to assume a substantially U-shaped or C-shaped cross-sectional outline shortly or immediately downstream of the pulley 16, namely in a zone or region which is indicated in FIG. 1 by an arrow D. The character E denotes the lowermost portions of the deformed upper reaches of the garnitures 17*a*, 17*b* between the pulley 16 and the pulley 6 where the inverted channels 1*a*, 1*b* end so that successive increments of the fillers 4*a*, 4*b* are contacted only by the respective webs 11*a*, 11*b*. Those portions of the garnitures 17*a*, 17*b* which advance beyond the pulleys 18*a*, 18*b* can be said to resemble troughs whose depth increases as seen in the direction of arrows 5 so that they gradually convert the respective webs 11*a*, 11*b* into tubular envelopes which confine the corresponding fillers 4*a* and 4*b*. The aforementioned seams can be stabilized by heating or by cooling the adhesive (depending on the nature of the selected adhesive) to thus enhance the resistance of the envelopes to bursting during advancement through the respective cutoffs which sever the leaders of the two cigarette rods at desired intervals. The resulting rows or files of plain cigarettes of unit length or multiple unit length can be admitted into one or two filter tipping machines (e.g., of the type known as MAX produced and distributed by the assignee of the present application) wherein the plain cigarettes are connected with filter rod sections of unit length or multiple unit length by resorting to so-called uniting bands. The filter rod sections are supplied by one or more machines which are or which can be similar to the illustrated machine except that the filler or fillers contain acetate fibers and/or other suitable filter material for tobacco smoke.

The present invention can be embodied with equal advantage in machines which are designed to produce a single continuous rod containing tobacco particles or filter material for tobacco smoke. For example, the invention can be embodied in filter rod making machines which are known as PROTOS 70, PROTOS 80, PROTOS 90 and PROTOS 100 (all produced and distributed by the assignee of the present application). Filter rod making machines which can be equipped with apparatus embodying the present invention can be of the type known as KDF 2, KDF 3 and MULFI (all produced and distributed by the assignee of the present application). Cigarette rod making machines which are designed to form a single substantially rod-like filler of tobacco particles are described and shown, for example, in commonly owned U.S. Pat. Nos. 4,185,644 (granted Jan. 29, 1980 to Heitmann et al.) and 5,154,190 (granted Oct. 13, 1992 to Heitmann).

When the machine of FIGS. 1 and 2 operates properly, the duct 12 continuously delivers two webs 11*a*, 11*b* which are trained around the pulley 16 and thereupon advance toward the station C where they are draped around the respective fillers 4*a*, 4*b*. Problems are likely to arise in the region which is indicated by the arrow B, namely where successive increments of the webs 11*a*, 11*b* approach and thereupon advance with the corresponding fillers 4*a*, 4*b*. For example, if one of the webs 11*a*, 11*b* breaks for any one of a number of different reasons, such as a weak spot, engagement with a hard fragment of a tobacco rib, the presence of a metallic particle in the oncoming filler and/or others, the leader of the next-following portion of the running web 11*a* or 11*b*, or the leader of a freshly introduced web, should be advanced to the wrapping station C in the same way as any portion of an undamaged running web; this reduces the likelihood of making a long series of defective rod-shaped articles of the tobacco processing industry. It is to be borne in mind that a machine of the character shown in FIGS. 1 and 2 is designed to turn out well in excess of 10,000 plain cigarettes per minute.

The speed of advancement of satisfactory webs 11*a*, 11*b* toward the wrapping station C at least approximates the speed of advancement of the lower reaches of the belts 3*a*, 3*b* and the speed of the upper reaches of the garnitures 17*a*, 17*b*.

The rod making machine is normally arrested in response to tearing of a web so as to provide time for introduction of the leader of a fresh web or of the leader of the trailing portion of a broken web into the range of the nozzles 13.1 and/or 13.2 in order to ensure that the leader will advance toward the wrapping station C in a manner which is best suited to avoid improper draping of the leader and of the next following portions of the web around the respective filler.

In heretofore known rod making machines, the leader of a fresh web is invariably clamped or gripped between the respective garniture and the respective filler not earlier than immediately downstream of the pulley 16, i.e., at a location ahead of the locus where a garniture begins to deform the running web while the web is already contacted by the adjacent filler. The filler engages one side of the web and the garniture engages the other side of such web to gradually drape the web around the filler and to move the marginal portions of the deformed web into engagement with one another in order to form the aforementioned seam. As can be seen in FIG. 1 by looking at the lines 3*a*.1 and 3*b*.1 (which denote the levels of the lower reaches of the belts 3*a*, 3*b* in the region B), successive increments of the webs 11*a*, 11*b* are adequately pressed against the adjacent fillers 4*a*, 4*b* and against the adjacent garnitures 17*a*, 17*b* only at or in the wrapping units 19*a*, 19*b*. This applies for heretofore known machines.

In accordance with the present invention, the improved apparatus includes means for reducing the (first) distance X between the belts 3*a*, 3*b* on the one hand and the webs 11*a*, 11*b* on the other hand to a lesser second distance X1 which is selected with a view to ensure proper grasping of the leader of a web 11*a* or 11*b* by the respective filler 4*a* or 4*b*, as well as by the respective garniture 17*a* or 17*b*, at least slightly ahead of the wrapping station proper.

The distance reducing means includes a first section 21*a* for the lower reach of the belt 3*a* and a second section 21*b* for the lower reach of the belt 3*b*. The sections 21*a*, 21*b* respectively comprises moving devices in the form of substantially vertically reciprocable pushers 23*a*, 23*b*. The directions in which certain portions of the lower reaches of the belts 3*a*, 3*b* can be moved downwardly in order to reduce the distance from X to X1 are indicated by arrows 22. The pushers 23*a*, 23*b* are reciprocably mounted in the bottom walls of the respective inverted channels 1*a*, 1*b* so that they can shift the adjacent portions of the advancing lower reaches of the belts 3*a*, 3*b* (and hence the corresponding portions of the fillers 4*a*, 4*b*) toward the neighboring portions of the respective webs 11*a*, 11*b*. This increases the pressure of the fillers 4*a*, 4*b* upon the respective webs 11*a*, 11*b*, i.e., the webs are biased against the respective garnitures 17*a*, 17*b* and are reliably entrained into the wrapping units 19*a*, 19*b* to be properly draped around the respective fillers. The arrangement is preferably such that, when the pushers 23*a*, 23*b* are caused to descend, they remain in their lower end positions for a certain interval of time which suffices to ensure that the leader of the web 11*a* or 11*b* has ample time to advance from the pulley 16 into the range of the respective garniture 17*a* or 17*b* and to be properly clamped between the garniture and the adjacent portion of the corresponding filler.

The lower reaches of the belts 3*a*, 3*b* assume the positions which are shown in FIGS. 1 and 2 by solid lines only when the pushers 23*a*, 23*b* are actuated to descend and to thus move the adjacent portions of the belts 3*a*, 3*b* away from the respective bottom surfaces 3*a*.1, 3*b*.1. The common drive means for the pushers 23*a*, 23*b* of the distance reducing means including the sections 21*a*, 21*b* includes a fluid-operated motor 24 (e.g., a pneumatic cylinder and piston unit) whose piston rod 29 carries a crosshead 30 mounting the upper end portions of the pushers 23*a* and 23*b*. The valve or valves which regulate the admission of a pressurized fluid into and evacuation of such fluid from the motor 24 includes an electronic or other suitable control unit 26 which is connected to actuating means 27 including devices 28*a* and 28*b* for monitoring the presence or absence of webs 11*a*, 11*b* in the duct 12. Detection of the presence of a web subsequent to detected absence is indicative of the advancement of the leader of the web 11*a* or 11*b* toward the pulley 16. The outputs of the monitoring devices 28*a*, 28*b* are connected to the inputs a and b of the actuating means 27 which reacts to the transmission of signals by causing the piston rod 29 to descend for a selected interval of time and to thus maintain the lower reaches of the belts 3*a*, 3*b* in the solid-line positions of FIGS. 1 and 2. This results in a reduction of distances X to X1. When the preselected interval of time has expired, a preferably adjustable timer or an analogous interval selecting device of the actuating means 27 causes the motor 24 to retract its piston rod 29*a* so that the pushers 23*a*, 23*b* rise and the lower reaches of the belts 3*a*, 3*b* assume the normal positions which are indicated by broken lines, i.e., those portions of lower reaches of the belts 3*a*, 3*b* which are adjacent the lower end portions of the pushers 23*a*, 23*b* return into contact with the internal surfaces 3*a*.1 and 3*b*.1 of the respective inverted channels 1*a*, 1*b*.

The monitoring devices 28*a*, 28*b* can constitute any commercially available detectors, e.g., in the forth of photodiodes which are capable of reacting to the detected presence of white color. As a rule, or at least in many instances, the material of the webs 11*a*, 11*b* is white paper or a paper having another light color. In the absence of the web 11*a* or 11*b* in the duct 12, radiation which is emitted by the radiation source of the detector 28*a* or 28*b* impinges upon and is reflected by a dark surface in the duct 12, and this causes the respective detector not to transmit a signal to the input a or b of the actuating means 27 or to transmit a signal which is indicative of the absence of the respective web 11*a* or 11*b*.

The actuating means 27 can further receive signals from one or more additional detectors or monitoring devices, e.g., from a detector 40 which transmits an electronic or other suitable signal to an input c of the actuating means 27 when the cigarette rod making machine is restarted subsequent to detected breakage of a web and following completion of threading of the leader of a fresh web or the leader of the remaining portion of an expiring web into the duct 12, e.g., to an extent which is necessary to advance the leader into the range of the nozzle 13.1 and/or 13.2. For example, a signal from the detector 40 to the input c of the actuating means 27 enables the actuating means to thereafter accept a signal at the input a or b when the leader reaches the detector 28*a* or 28*b*. As already mentioned above, this causes the control means 26 for the motor 24 to induce the motor to lower the pushers 23*a*, 23*b* and to thus reduce the distances X to the distances X1 which suffice to ensure that the leader of the web 11*a* or 11*b* invariably contacts the underside of the respective filler 4*a* or 4*b* and is properly clamped between such filler and the respective garniture 17*a* or 17*b* to be entrained into the corresponding wrapping unit 19*a* or 19*b*. In other words, the pushers 23*a*, 23*b* then displace the adjacent portions of lower reaches of the belts 3*a*, 3*b* downwardly and away from the respective surfaces 3*a*.1 and 3*b*.1. The extent of displacement by the pushers 23*a*, 23*b* need not be very large, as long as it suffices to ensure reliable clamping of the leader of a web 11*a* or 11*b* between the filler 4*a* and the garniture 17*a* or between the filler 4*b* and the garniture 17*b*.

The motor 24 can contain one or more springs or the like (not shown) for permanently biasing the pushers 23*a*, 23*b* to their upper end positions (this is indicated by the arrow 31 which is shown in FIG. 2).

Even if those portions of lower reaches of the belts 3*a*, 3*b* which are immediately adjacent the undersides of the pushers 23*a*, 23*b* are temporarily moved away from the adjacent portions of the suction chamber or chambers, this does not affect the entrainment of the fillers 4*a*, 4*b* toward the wrapping station C. The reason is that those portions of the lower reaches of the belts 3*a*, 3*b* which are located upstream and downstream of the pushers 23*a*, 23*b* enable air to flow therethrough and into the adjacent portions of the suction chamber or chambers above the inverted channels 1*a*, 1*b* to thus ensure that the upper sides of the fillers 4*a*, 4*b* are attracted to the lower reaches of the respective belts 3*a* and 3*b*.

It is clear that only one pusher 23*a* or 23*b* is needed if the improved apparatus is incorporated in a machine which is designed to turn out a single filler of tobacco or filter material. Thus, a cigarette maker known as PROTOS 70, PROTOS 80, PROTOS 90 or PROTOS 100 will employ a single pusher, a single inverted channel for the single filler and a single detector 28*a* or 28*b*.

It is equally within the purview of the invention to provide the apparatus which is shown in FIGS. 1 and 2 with discrete motors for the pushers 23*a*, 23*b* and with discrete actuating means for such discrete motors. A signal from the detector 28*a* or 28*b* then merely initiates a downward movement of one of the two pushers for a selected interval of time. The illustrated apparatus which employs a single motor 24 is preferred at this time due to its simplicity, compactness, low cost and longer useful life.

An important advantage of the improved apparatus is that it ensures reliable entrainment of the leader of a fresh web or of the leader of an unexpired web into the range of the respective garniture to thus ensure predictable and reliable entrainment of the leader and of the next-following portions of the web at an optimum speed, i.e., at the speed of advancement of the respective filler. Another advantage of the improved apparatus is that it can automatically thread the leader of a web 11*a* or 11*b* into the respective wrapping unit 19*a* or 19*b*; this reduces the likelihood that the machine would turn out long series of defective rod-shaped articles.

The improved apparatus can be modified in a number of additional ways. For example, the pushers 23*a*, 23*b* could be replaced with devices which are designed to pull the adjacent portions of the lower reaches of the belts 3*a*, 3*b* away from the respective surfaces 3*a*.1 and 3*b*.1, as long as the distances X are reduced to an extent which is necessary to ensure predictable advancement of the leaders of webs into the respective wrapping units.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

I claim:

1. Apparatus for uniting a running web containing wrapping material and having a leader with a substantially rod-like filler of particulate material of the tobacco processing industry, comprising first conveyor means having means for advancing the filler along a first path in a first direction toward a wrapping station; second conveyor means having means for advancing the web toward said station along a second path including a portion disposed at a first distance from a portion of said first path; and means for at least temporarily reducing the first distance to a lesser second distance, including means for moving at least one of said advancing means toward the other of said advancing means and means for actuating said moving means to reduce said first distance not later than on advancement of the leader of the web into said portion of said second path.

2. The apparatus of claim 1, further comprising means for draping the web around the filler at said station, including third conveyor means having means for jointly advancing the web and the filler along a third path.

3. The apparatus of claim 1, wherein said moving means includes means for moving the advancing means of said first conveyor means toward the advancing means of said second conveyor means.

4. The apparatus of claim 1, wherein said moving means is activatable to move said at least one advancing means toward said other advancing means and said actuating means comprises means for activating said moving means for predetermined intervals of time.

5. The apparatus of claim 4, wherein said activating means includes means for monitoring the second path for the arrival of the leader of the web at said portion of said second path and for activating said moving means upon detected arrival of the leader.

6. The apparatus of claim 1, wherein at least one of said advancing means comprises an endless flexible element.

7. The apparatus of claim 1, wherein said at least one advancing means is located at a level above said other advancing means.

8. The apparatus of claim 1 for uniting each of a plurality of running webs with a discrete one of a plurality of substantially rod-like fillers, wherein said first conveyor means includes discrete advancing means for said plurality of fillers and said second conveyor means includes advancing means for said plurality of webs, each advancing means of said first conveyor means being adjacent the advancing means of said second conveyor means and said distance reducing means including means for at least temporarily moving the advancing means of one of said conveyor means toward the advancing means of the other of said conveyor means.

9. The apparatus of claim 8, wherein at least one of said conveyor means comprises two advancing means.

10. The apparatus of claim 8, wherein the paths defined by the advancing means of at least one of said conveyor means are at least substantially parallel to each other.

11. The apparatus of claim 8, wherein the advancing means of at least one of said conveyor means are closely adjacent each other.

12. The apparatus of claim 8, wherein said moving means includes a discrete moving device for each advancing means of said at least one conveyor means.

13. The apparatus of claim 12, wherein said distance reducing means further comprises common drive means for said discrete moving devices.

14. The apparatus of claim 13, wherein said devices include reciprocable pushers and said drive means comprises a fluid-operated motor for said pushers.

15. The apparatus of claim 1, wherein said portions of said paths are adjacent said wrapping station.

16. The apparatus of claim 1, further comprising means for draping the web around the filler at said station, including third conveyor means for jointly advancing the web and the filler along a third path constituting an extension of one of said first and second paths.

17. The apparatus of claim 16, wherein said third path is an extension of said first path.

18. Apparatus for uniting a running web of wrapping material with a substantially rod-like filler of particulate material of the tobacco processing industry, comprising first conveyor means having means for advancing the filler along a first path in a first direction toward a wrapping station; second conveyor means having means for advancing the web toward said station along a second path including a portion disposed at a first distance from a portion of said first path; and means for at least temporarily reducing said first distance to a lesser second distance, including means for moving at least one of said advancing means toward the other of said advancing means, said moving means being actuatable to move said at least one advancing means toward the other advancing means and said distance reducing means further comprising means for activating said moving means for predetermined intervals of time, said activating means including means for monitoring the second path for the arrival of a leader of the web at said portion of said second path and for activating said moving means upon detected arrival of the leader.

* * * * *